US005180984A

United States Patent [19]

Murata et al.

[11] Patent Number: 5,180,984

[45] Date of Patent: Jan. 19, 1993

[54] ION CURRENT SENSING DEVICE FOR AN INTERNAL COMBUSTION ENGINE WITH SPURIOUS VOLTAGE PREVENTING FILTER

[75] Inventors: Shigemi Murata; Masayuki Ikeuchi, both of Himeji, Japan

[73] Assignee: Mitsubishi Denki Kabushiki Kaisha, Tokyo, Japan

[21] Appl. No.: 774,233

[22] Filed: Oct. 10, 1991

[30] Foreign Application Priority Data

Oct. 12, 1990 [JP] Japan ..... 2-272109

[51] Int. Cl.[5] ..... F02P 17/00

[52] U.S. Cl. ..... 324/399; 324/391; 324/378; 123/425

[58] Field of Search ..... 324/378, 388, 390, 391, 324/392, 393, 399; 123/425

[56] References Cited

U.S. PATENT DOCUMENTS 3,942,102 3/1976 Kuhn et al. ..... 324/399

4,762,106 8/1988 Blauhut ..... 123/425

*Primary Examiner*—Gerard R. Strecker

*Assistant Examiner*—Diep Do

*Attorney, Agent, or Firm*—Sughrue, Mion, Zinn, Macpeak and Seas

[57] ABSTRACT

An ion current sensing device for an internal combustion engine is able to accurately sense an ion current generated between electrodes of a spark plug during combustion of a mixture even when the electrodes have been smeared by carbon or other combustion products deposited or accumulated thereon. A power source 14 supplies a bias voltage to the electrodes of the spark plug. An ion current sensing resistor 15 is connected between the elecrodes of the spark plug and the power source for sensing an ion current as generated between the electrodes of the spark plug each time a mixture in the combustion chamber is combusted. A comparator 11 compares the voltage across the ion current sensing resistor with a reference voltage and generates an output signal when the voltage is higher than the reference voltage. A filter comprising a capacitor 22 and a resistor 23 is connected between the ion current sensing resistor and the comparator for passing only AC components of the voltage across the ion current sensing resistor to the comparator while blocking a DC component thereof.

2 Claims, 2 Drawing Sheets

ION CURRENT SENSING DEVICE FOR AN INTERNAL COMBUSTION ENGINE WITH SPURIOUS VOLTAGE PREVENTING FILTER

BACKGROUND OF THE INVENTION

The present invention relates to an ion current sensing device for an internal combustion engine which can accurately sense an ion current generated between electrodes of a spark plug during combustion of a mixture in an engine cylinder for an extended period of engine operation.

FIG. 2 is a schematic diagram showing the general arrangement of an ignition device in an internal combustion engine equipped with a known ion current detecting device. The ignition device illustrated includes an ignition coil 1 having a primary winding and a secondary winding which is connected to a computerized engine control unit (ECU) 3 through a switch element 2 in the form of a power transistor. The power transistor 2 has a collector coupled to the primary winding of the ignition coil 1, a base coupled to the ECU 3 which controls the ignition timing of an engine cylinder 7, and an emitter grounded. The secondary winding of the ignition coil 1 is connected to a cathode of a reverse-current checking diode 4 whose anode is connected to a spark plug 5 which is mounted on the head of the engine cylinder 7 in which a piston 7a is received for reciprocating motion. The spark plug 5 has electrodes 5a thereof present in a combustion chamber 6 defined in the engine cylinder 7 for igniting an air/fuel mixture therein. A signal generator 8 senses the crank angle or rotational position of the piston 7a or a crankshaft 18 connected therewith and generates a corresponding crank angle signal in synchronism with the rotation of the crankshaft 18. An ion current sensing device, which is generally designated by reference numeral 9, is connected at an input terminal thereof through a diode 16 to a junction between the reverse-current checking diode 4 and the spark plug 5 and at an output terminal thereof to the control unit 3. The ion current sensing device 9 includes a signal processor 10 which is connected at its output to the output terminal of the device 9 which is in turn connected to the ECU 3, and a comparator 11 which has a first input terminal connected to a junction A between the cathode of the diode 16 and one end of an ion current sensing resistor 15 whose other end is connected to a negative terminal of a DC power source 14, and a second input terminal on which a reference voltage V1 is imposed for comparing a voltage $V_2$ across the resistor 15, which corresponds to an ion current generated by combustion of the mixture in the combustion chamber 6 and fed to the resistor 15 via the diode 16, as shown by an arrow 17 in FIG. 2, with the reference voltage $V_1$. The second input terminal of the comparator 11 is connected through a resistor 13 to a junction B between the resistor 15 and the DC power source 14. A resistor 12 is connected at its one end to a node between the resistor 13 and the second input terminal of the comparator 11, and at its other end to a power supply. When the voltage $V_2$ across the ion current sensing resistor 15 as applied to the first input terminal of the comparator 11 becomes higher than the reference voltage $V_1$ applied to the second input terminal thereof, the comparator 11 generates an output signal which is fed to the signal processor 10 which then generates an ion current sensing signal 19 to the ECU 3.

In this connection, the reference voltage $V_1$ is expressed as follows:

$$V_1 = V_0 + (V_{cc} - V_0) \times R_2/(R_1 + R_2)$$

where $V_0$ is the voltage at the junction B; $V_{cc}$ is the source voltage of the power supply connected to the resistor 12; $R_1$ is the resistance of the resistor 12; and $R_2$ is the resistance of the resistor 13.

In operation, when the power transistor 2 is turned off by a control signal from the ECU 3, there is developed a high negative voltage 20 across the secondary winding of the ignition coil 1, which is supplied via the diode 4 to the spark plug 5 whereby a spark is generated between the electrodes 5a of the spark plug 5 to fire an air/fuel mixture in the combustion chamber 6 in the cylinder 7. On this occasion, since the high voltage 20 thus generated across the secondary winding of the ignition coil 1 is negative, it is interrupted by the diode 16 and does not transmit to the ion current sensing device 9. During combustion of the mixture in the combustion chamber 6, an ion current is generated between the electrodes 5a of the spark plug 5 and it is fed via the diode 16 to the ion current sensing unit 9, as shown by the arrow 17 in FIG. 2, since an input terminal (or junction A) of the device 9 is biased to a negative voltage by the DC power source 14. As a consequence, there develops a voltage $V_2$ across the resistor 15 which is fed to the first input terminal of the comparator 11 where it is compared with the reference voltage $V_1$ applied to the second input terminal thereof. When the voltage $V_2$ becomes higher than the reference voltage $V_1$, the comparator 11 generates an output signal which is then fed to the signal processor 10. The signal processor 10 processes the output signal from the comparator 11 and generates an ion current sensing signal 19 to the ECU 3. Based on this signal 19 as well as a crank angle signal from the signal generator 8, the ECU 3 determines that normal combustion has taken place in the cylinder 7.

With the known ion current sensing device as constructed above, if carbon, other combustion products and the like are deposited or accumulated on the surfaces of the electrodes 5a of the spark plug 5 during an extended period of engine operation, the electrodes 5a become subject to a negative bias voltage from the DC power source 14, and a limited leakage current thus flows from the positive terminal of the DC power source 14 to the negative terminal thereof through the electrodes 5a of the spark plug 5, the diode 16 and the resistor 15. As a result, a voltage is always developed across the resistor 15, so that the condition of $V_2 > V_1$ is always established. Thus, it follows that the comparator 11 malfunctions to generate an output signal at all times irrespective of the presence or absence of an ion current, considerably impairing the operational reliability of the ion current sensing device 9.

SUMMARY OF THE INVENTION

Accordingly, the present invention is intended to overcome the above-mentioned problems encountered with the known ion current sensing device.

An object of the invention is to provide a novel and improved ion current sensing device for an internal combustion engine which is able to accurately sense an ion current generated between electrodes of a spark plug during combustion of a mixture even when the electrodes have been smeared by carbon or other combustion products deposited or accumulated thereon.

In order to achieve the above object, according to the present invention, there is provided an ion current sensing device for an internal combustion engine having a spark plug with electrodes present in a combustion chamber in a cylinder. The device comprises: a power source for supplying a bias voltage to the electrodes of the spark plug; ion current sensing means connected between the electrodes of the spark plug and the power source for sensing as a voltage an ion current which is generated between the electrodes of the spark plug each time a mixture in the combustion chamber is combusted; signal processing means for comparing the voltage corresponding to the ion current as sensed by the ion current sensing means with a reference voltage and generating an output signal when the voltage corresponding to the ion current is higher than the reference voltage; and a filter connected between the ion current sensing means and the signal processing means for passing only AC components of the voltage corresponding to the ion current to the signal processing means while blocking a DC component of the voltage as sensed by the ion current sensing means.

The ion current sensing means comprises a resistor having one end thereof connected to the electrodes of the spark plug and the other end thereof connected to the power source. Preferably, the filter comprises a capacitor having one end thereof connected to a junction between the electrodes of the spark plug and the resistor, and the other end thereof connected to the signal processing means, and a resistor having one end thereof connected to ground and the other end thereof connected to a junction between the capacitor and the signal processing means.

The above and other objects, features and advantages of the invention will be more readily apparent from the following detailed description of a preferred embodiment of the invention taken in conjunction with the accompanying drawings.

BRIEF DESCRIPTION OF THE DRAWINGS

In the drawings, the same and corresponding parts are identified by the same symbols.

DESCRIPTION OF THE PREFERRED EMBODIMENT

A preferred embodiment of the invention will now be described in detail with reference to the accompany drawings.

Figure 1:
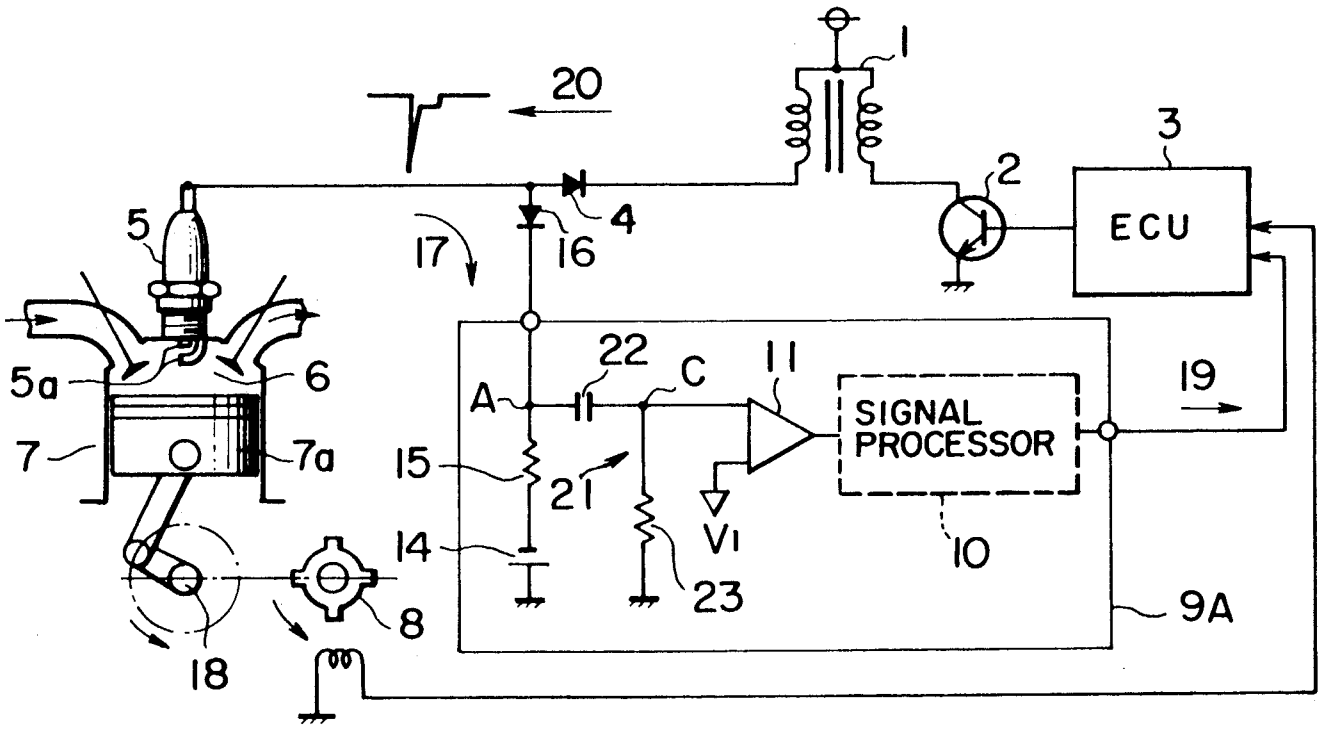
FIG. 1 is a circuit diagram of an ion current sensing device for an internal combustion engine in accordance with the present invention.
Figure 2:
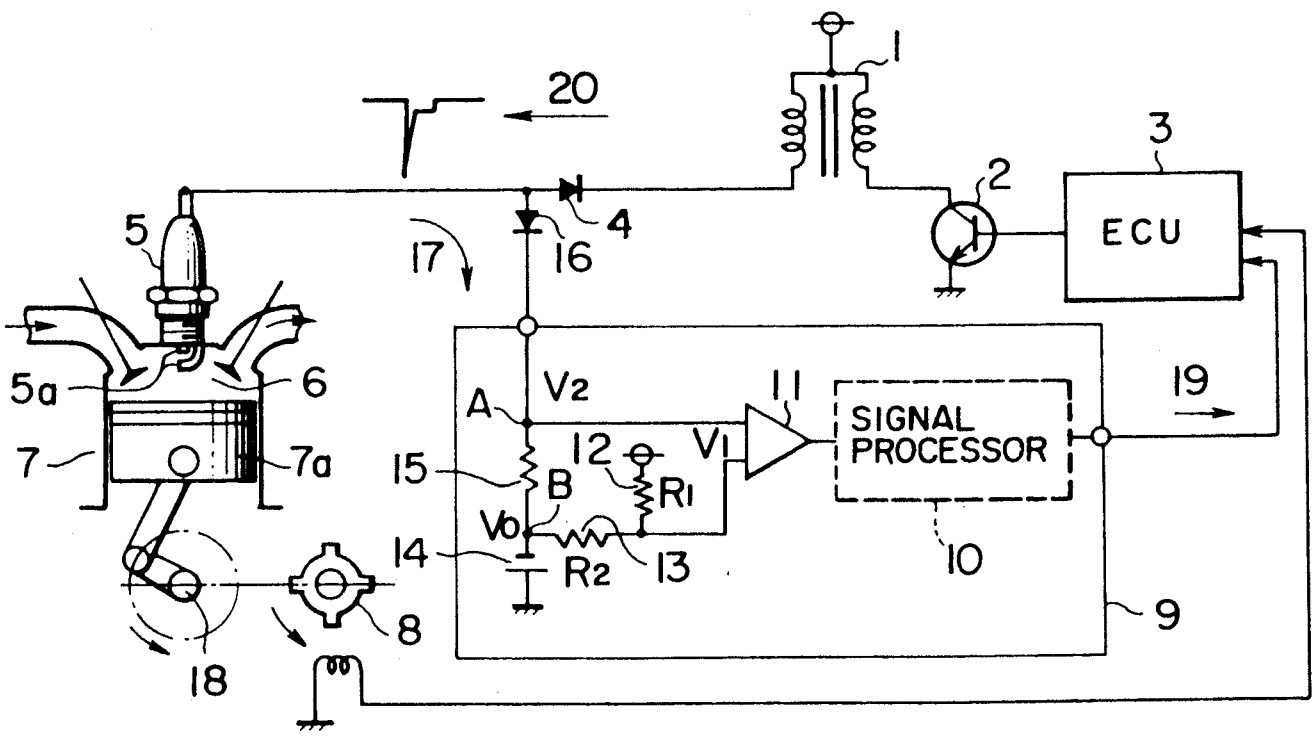
FIG. 2 is a view similar to FIG. 1, but showing a known ion current sensing device.

FIG. 1 shows an ion current sensing device for an internal combustion engine constructed in accordance with principles of the invention. The ion current sensing device, generally designated by reference symbol 9A, is substantially similar to the one 9 illustrated in FIG. 2 except for the following features. Specifically, the ion current sensing device 9A includes a signal processor 10, which is the same as that of FIG. 2 and which is connected at its output terminal to an engine control device 3, and a comparator 11 connected at an output terminal thereof to an input terminal of the signal processor 10. The comparator 11 has a first input terminal connected via a filter 21 to a junction A, at which one end of an ion current sensing means 15 in the form of a resistor, whose other end is connected to a negative terminal of a DC power source 14, is connected to electrodes 5*a* of a spark plug 5 through a diode 16, and a second input terminal upon which a reference voltage $V_1$ is imposed. The signal processor 10 and the comparator 11 together constitute a signal processing means as claimed of the invention. The filter 21 comprises a capacitor 22 connected at one end thereof to the junction A and at the other end thereof to the first input terminal of the comparator 11, and a resistor 23 connected at one end thereof to ground and at the other end thereof to a junction C between the capacitor 22 and the first input terminal of the comparator 11. Thus, the filter 21 functions to pass only high-frequency components of a voltage developed across the resistor 15 to the first input terminal of the comparator 11 while blocking or removing a DC component and low frequency components thereof which are unrelated to an ion current generated between the electrodes 5*a* of the spark plug 5 during combustion of a mixture in a combustion chamber 6 in a cylinder 7.

In operation, when the power transistor 2 is turned off by a control signal from the ECU 3, a high negative voltage 20 is generated across the secondary winding of the ignition coil 1, and it is supplied via the diode 4 to the spark plug 5 whereby a spark is generated between the electrodes 5*a* of the spark plug 5 to fire an air/fuel mixture in the combustion chamber 6 in the cylinder 7. On this occasion, since the high voltage 20 thus generated across the secondary winding of the ignition coil 1 is negative, it is interrupted by the diode 16 and does not transmit to the ion current sensing device 9A. Every time the mixture in the combustion chamber 6 is combusted, an ion current is generated between the electrodes 5*a* of the spark plug 5 and it is fed via the diode 16 to the ion current sensing device 9A, as shown by the arrow 17 in FIG. 1, because of the input terminal or junction A of the device 9A being biased to a negative voltage by the DC power source 14. Consequently, there develops a high frequency voltage $V_2$ across the resistor 15 which is fed via the filter 21 comprising the capacitor 22 and the resistor 23 to the first input terminal of the comparator 11 where it is compared with the reference voltage $V_1$ applied to the second input terminal thereof. When the voltage $V_2$ becomes higher than the reference voltage $V_1$, the comparator 11 generates an output signal which is then fed to the signal processor 10 which processes the output signal from the comparator 11 and generates an ion current detection signal 19 to the ECU 3, as in the aforementioned known ion current sensing device of FIG. 2. Based on this signal 19 as well as a crank angle signal from the signal generator 8, the ECU determines that normal combustion has taken place in the cylinder 7.

According to the ion current sensing device 9A of the present invention, even if carbon or other combustion products are deposited on the surfaces of the electrodes 5*a* of the spark plug 5 to allow a DC leakage current to flow from the positive terminal of the DC power source 14 to the negative terminal thereof by way of the electrodes 5*a* of the spark plug 5, the diode 16 and the resistor 15 while generating a DC voltage across the resistor 15, the DC voltage thus generated is blocked by the capacitor 22 from transmitting to the first input terminal of the comparator 11. As a result, the ion current sensing device 9A of the invention is able to accurately sense an ion current during an extended period of engine operation, so reliability in the device is substantially improved.

What is claimed is:

1. An ion current sensing device for an internal combustion engine having a spark plug with electrodes present in a combustion chamber in a cylinder, said device comprising:

a) a power source (14) for supplying a bias voltage to the electrodes of said spark plug;

b) ion current sensing means (15, 16) connected between the electrodes of said spark plug and said power source for sensing as a voltage an ion current which is generated between the electrodes of said spark plug each time a mixture in the combustion chamber is combusted;

c) signal processing means (10, 11) for comparing the voltage corresponding to the ion current as sensed by said ion current sensing means with a reference voltage and generating an output signal when the voltage corresponding to the ion current is higher than the reference voltage; and d) means for preventing a spurious voltage from being applied to the signal processing means due to a leakage current flow through the power source and the ion current sensing means resulting from spark plug contamination, said preventing means comprising:

e) a filter (21) connected between said ion current sensing means and said signal processing means for passing only AC components of the voltage corresponding to the ion current to said signal processing means while blocking a DC component of the voltage as sensed by said ion current sensing means.

2. An ion current sensing device according to claim 1, wherein said ion current sensing means comprises a resistor having one end thereof connected to the electrodes of said spark plug and the other end thereof connected to said power source, and said filter comprises a capacitor (22) having one end thereof connected to a junction between the electrodes of said spark plug and said resistor, and the other end thereof connected to said signal processing means, and a resistor (23) having one end thereof connected to ground and the other end thereof connected to a junction between said capacitor and said signal processing means.

* * * * *